US006250776B1

(12) United States Patent
Burkitt et al.

(10) Patent No.: US 6,250,776 B1
(45) Date of Patent: Jun. 26, 2001

(54) NICHE ASSEMBLY FOR A POOL AND METHOD THEREFOR

(75) Inventors: Garrett J. Burkitt, Simi Valley, CA (US); Darrin K. Pickle, Rogers, AK (US)

(73) Assignee: PacFab, Inc., Moorpark, CA (US)

( * ) Notice: Subject to any disclaimer, the term of this patent is extended or adjusted under 35 U.S.C. 154(b) by 0 days.

(21) Appl. No.: 09/341,501

(22) PCT Filed: Nov. 20, 1997

(86) PCT No.: PCT/US97/21312

§ 371 Date: Jun. 9, 1999

§ 102(e) Date: Jun. 9, 1999

(87) PCT Pub. No.: WO99/27299

PCT Pub. Date: Jun. 3, 1999

(51) Int. Cl.[7] ..... F21V 29/00

(52) U.S. Cl. ..... 362/267; 362/145; 362/147; 362/101; 362/364

(58) Field of Search ..... 362/145, 147, 362/267, 101, 364

(56) References Cited

U.S. PATENT DOCUMENTS

| | | | | |
|---|---|---|---|---|
| 2,163,329 | | 6/1939 | Sipior | 362/365 |
| 2,906,863 | | 9/1959 | Ritter | 248/342 |
| 3,845,291 | | 10/1974 | Portyrata | 340/606 |
| 3,868,732 | | 3/1975 | Engelhart | 403/195 |
| 3,962,675 | * | 6/1976 | Rowley et al. | 362/101 |
| 4,433,366 | * | 2/1984 | Wade | 362/267 |
| 4,539,629 | | 9/1985 | Poppenheimer | 362/294 |
| 4,561,134 | | 12/1985 | Mathews et al. | 4/498 |
| 4,587,599 | | 5/1986 | St-Hilaire | 362/267 |
| 4,704,660 | | 11/1987 | Robbins | 362/293 |
| 4,731,887 | | 3/1988 | Henkin et al. | 4/492 |
| 4,782,430 | | 11/1988 | Robbins et al. | 285/136 |
| 5,000,665 | | 3/1991 | Moeller | 362/101 |
| 5,045,978 | * | 9/1991 | Gargle | 362/101 |
| 5,169,228 | | 12/1992 | Breitzler | 362/307 |
| 5,217,292 | | 6/1993 | Chalberg | 362/101 |
| 5,408,706 | | 4/1995 | Barnes | 4/507 |

OTHER PUBLICATIONS

PCT Search Report dated Jul. 27, 1998.

* cited by examiner

*Primary Examiner*—Thomas M. Sember
*Assistant Examiner*—Ali Alavi
(74) *Attorney, Agent, or Firm*—Christie, Parker & Hale, LLP

(57) ABSTRACT

A niche assembly (8) for a pool having outer wall (20), flange (22) and boss (34) formed on the flange. The boss is configured to inset in small hole (38) of pool wall (40) when the niche is fully inserted into large hole (42). At least one handle (32) is formed on backup ring (12) that screws on to the niche to mount the niche to the pool wall. The inset boss prevents rotation of the niche. The niche further includes plurality of ribs (50) formed on the outer wall. The backup ring further includes a tab (56) projecting towards the ribs. The tab and the ribs cooperate to impede unscrewing the backup ring off the niche. A seal ring (16) and 24. a gasket (18) seal a vinyl liner (64) to the flange. The seal ring has a sloping outer edge (68) and the flange has a beveled outer edge (72).

19 Claims, 3 Drawing Sheets

NICHE ASSEMBLY FOR A POOL AND METHOD THEREFOR

FIELD OF THE INVENTION

The present invention relates generally to the field of lighting, and, more particularly, to a niche assembly, and methods therefore. Although the present invention is subject to a wide range of applications, it is especially suited for use in a pool, and will be particularly described in that connection.

BACKGROUND OF THE INVENTION

A pool light can illuminate the pool from under the surface of the water. A niche assembly provides a way to mount the pool light to a side wall of a pool. As used herein, a pool is used generically to refer to a tank for holding water. Examples of such tanks are recreational swimming pools, spas, and aquariums.

Conventional lighting fixture assemblies for mounting pool lights are known. The niche assembly usually includes a niche, which houses various components that comprise the pool light, such as, the lamp, the lamp socket, and wires leading to the lamp socket. The niche is typically inside mounted, that is, inserted through an opening in the side wall from the inside the pool. A gasket that provides a watertight seal is located between the inner surface of the pool wall and a flange of the niche. The housing has external threads that extend beyond the outer surface of the pool wall. A ring nut with internal threads is used to mount the niche on the wall of the swimming pool by engaging the threads. Thus, the side wall of the swimming pool is captured between the nut and the combination of the flange and gasket.

Although suitable for some pool installations, the conventional niche assembly is cumbersome to mount to the pool wall, and often requires a special tool, such as a plumber's wrench, to grasp the ring nut and provide the torque necessary to tighten the ring nut sufficiently enough to obtain a watertight seal. Furthermore, there must be a means for preventing the niche from rotating as the ring nut is tightened. Oftentimes, two installers are necessary to mount the niche assembly. One inside the pool to hold the niche to prevent it from rotating, and one outside the pool to rotate the ring nut. This doubling of labor can increase the cost of the installation.

Moreover, the ring nut can loosen, and the pool light can wobble. It can be costly to re-tighten a loose pool light after installation is complete. An adhesive can be used to secure the ring nut, but this can increase the time and cost to install the pool light.

Instead of using fiberglass pool walls, it is known to install a vinyl lining over pressboard or metal walls of the pool to make the pool watertight. A conventional fitting assembly for a vinyl-lined pool uses a fitting and faceplate combination. The fitting has a flange with a rear surface that contacts the inside pool wall. A gasket and a faceplate hold the vinyl liner against the flange to provide a watertight seal.

Although suitable for some pool installations, the vinyl lining can tear at the edge of the flange because the flange's front surface is not flush with the inside pool wall. Thus, a step is formed from the pool wall to the flange's front surface that the vinyl lining must follow. If the lie of vinyl lining does not follow the step, e.g., it is stretched tight allowing an air gap between the vinyl liner and the lap of the step, a swimmer brushing up against the vinyl liner can cause the vinyl to puncture. Accordingly, the pool would leak and the water can cause damage.

Moreover, conventional niche assemblies are typically mounted to the pool wall by screws through holes around the flange. There are typically about four to ten holes in the flange. Installation requires drilling holes into the pool wall that perfectly match the holes in the flange, aligning the gasket to the drilled holes and the flange to the drilled holes, ensuring the niche assembly is properly oriented, and screwing the screws throught the flange and gasket into the holes in the pool wall. This is a labor intensive procedure with opportunity for error. For example, the holes may not be drilled to match the flange holes, and, even if the holes are drilled correctly, the niche can be mounted with an improper orientation as it may be rotated one or more holes from proper orientation. A need therefore exists for a niche assembly, and methods therefore, that does not require a special tool to mount the niche assembly to the pool wall, can be mounted by a single installer, will not easily loosen with time and wear, mitigates punctures of the vinyl liner around the pool light in a vinyl-lined pool installation, and is not labor intensive or error prone.

SUMMARY OF THE INVENTION

The present invention, which tends to address this need, resides in a niche assembly, and methods therefore. The niche assembly described herein provides advantages over known lighting fixture assemblies in that a special tool is not required to mount the niche assembly to obtain a watertight seal, a single installer can perform the installation, the pool light will not easily loosen with time and wear, the vinyl layer is less susceptible to tears around the pool light, and is not labor intensive or error prone.

According to the present invention, providing leverage for screwing the backup ring on the niche. This is accomplished by at least one handle formed on the backup ring. Thus, the backup ring can be manually screwed on without the use of a special tool and the installation is not labor intensive.

In accordance with one aspect of the present invention, preventing the rotation of the niche when the backup ring rotates onto the niche. This is accomplished by a boss formed on a flange of the niche that is configured to inset in a small hole formed in the pool wall when the niche is fully inserted into a large hole of the wall. Thus, a second installer is not required to prevent the niche from rotating. Furthermore, proper orientation of the niche assembly is assured.

In accordance with another aspect of the present invention, impeding the rotation of the backup ring in one direction. This is accomplished by a plurality of ribs on the niche and a tab of the backup ring that abuts against a one of the ribs. Thus, the pool light will not easily loosen with time and wear.

Moreover, according to the present invention, gradually sloping the vinyl lining from the pool wall to the flange. This is accomplished by beveling the outer edge of the flange and sloping the outer edge of a seal ring. Thus, the vinyl layer is less susceptible to tears around the pool light because there is no abrupt step from the wall to the flange.

In accordance with the method for mounting a niche assembly of this invention, screwing a backup ring onto the niche by use of at least one handle formed on the backup ring.

The method more particularly comprises inserting a boss formed on the flange into the small hole when inserting the niche through the large hole.

In accordance with a method of manufacture of this invention, forming at least one handle on the backup ring.

The method of manufacture more particularly comprises forming a boss on the flange, and configuring the boss to be inset into a small hole of a pool wall when the niche is fully inserted into a large hole of the pool wall.

Other features and advantages of the present invention will be set forth in part in the description which follows and accompanying drawings, wherein the preferred embodiments of the present invention are described and shown, and in part become apparent to those skilled in the art upon examination of the following detailed description taken in conjunction with the accompanying drawings, or may be learned by practice of the present invention. The advantages of the present invention may be realized and attained by means of the instrumentalities and combinations particularly pointed out in the appended claims.

DESCRIPTION OF THE PREFERRED EMBODIMENTS

Figure 1:
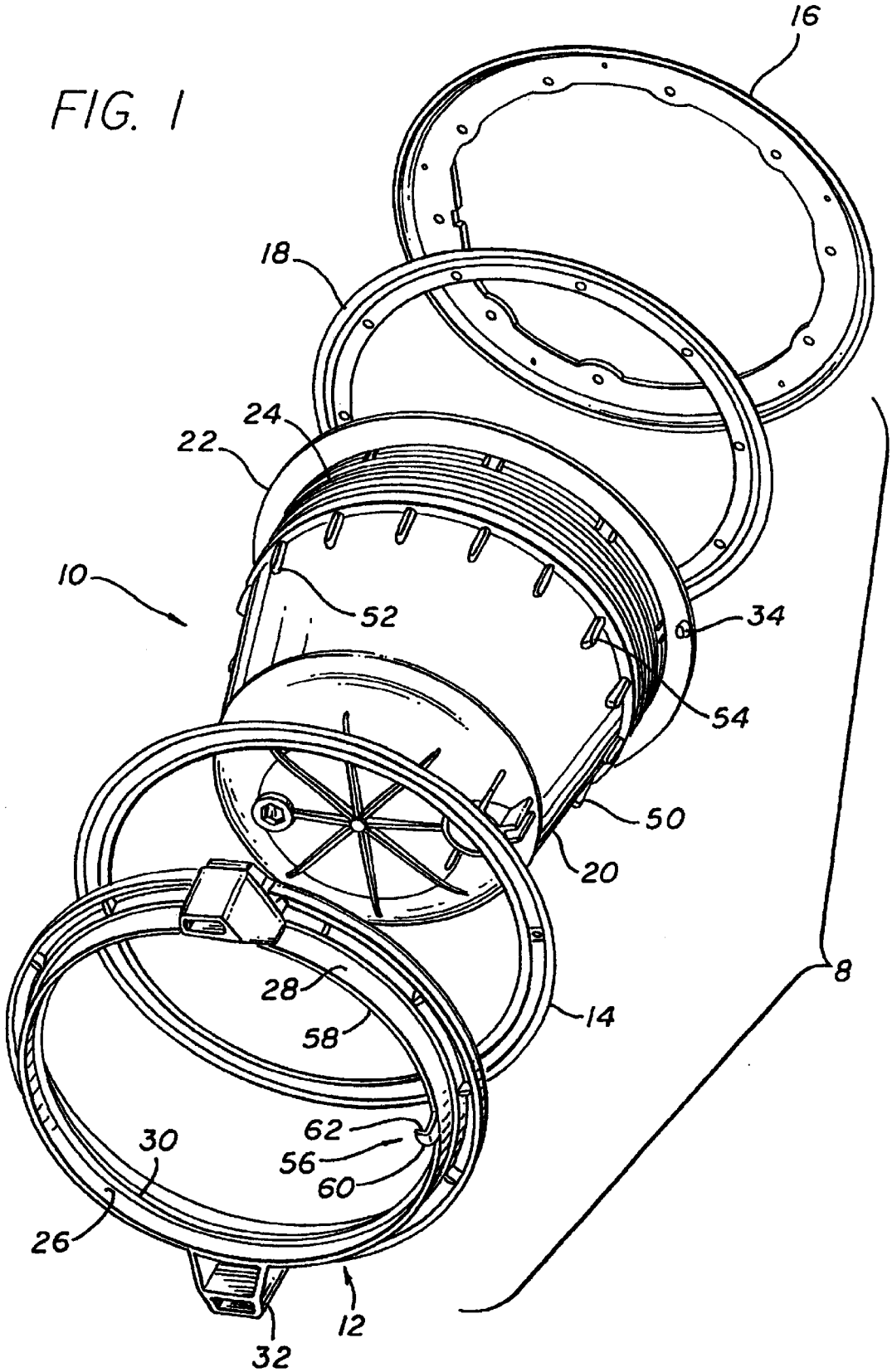
FIG. 1 is an exploded rear perspective view of a niche assembly configured according to the present invention.

As shown in the exemplary drawings, and with particular reference to FIG. 1, which is an exploded rear perspective view of a niche assembly, the present invention is embodied in a niche assembly 8 comprising a niche 10, a backup ring 12, a first gasket 14, a seal ring 16, and a second gasket 18.

The niche 10 houses a lamp and other certain electrical components of the pool light. The niche 10 has a bowl-shaped outer wall 20 and includes a flange 22 and external threads 24. An end of the outer wall 20 defines an opening 26 (see FIG. 2) into the niche 10.

The flange 22 is formed on the outer wall 20 for limiting the insertion of the niche 10 through a large hole in the pool wall. The flange 22 can be formed on the periphery of the opening 26, and the external threads 24 can be formed on the outer wall 20 adjacent the flange 22 and can extend beyond the pool wall when the niche 10 is fully inserted into the large hole.

The backup ring 12 screws onto the niche 10 and securely fastens the niche 10 to the pool wall. The backup ring 12 includes an internal surface 27 and an external surface 28. The internal surface 26 has internal threads 30 formed thereon, and the internal threads 30 are configured to mesh with the external threads 24.

The first gasket 14 provides a watertight seal between the pool wall and the flange 22. In the preferred embodiment the first gasket 14 is not required when the pool has a vinyl liner. The seal ring 16 and second gasket 18 seal the vinyl liner to the flange 22. The seal ring 16 is typically screwed on to the niche 10.

In this illustrated embodiment, which is configured according to the present invention, at least one handle 32 is formed on the external surface 28 of the ring. In the illustrated embodiment there are two diametrically opposed handle 32. The at least one handle 32 provides sufficient leverage so that the backup ring 12 can be manually screwed onto the niche 10, without the use of a special tool, to fixedly mount the niche 10 to the pool wall. Furthermore, drilling of multiple holes, aligning the gasket and flange to the holes, and screwing in screws to mount the niche assembly to the pool wall are not required.

Figure 2:
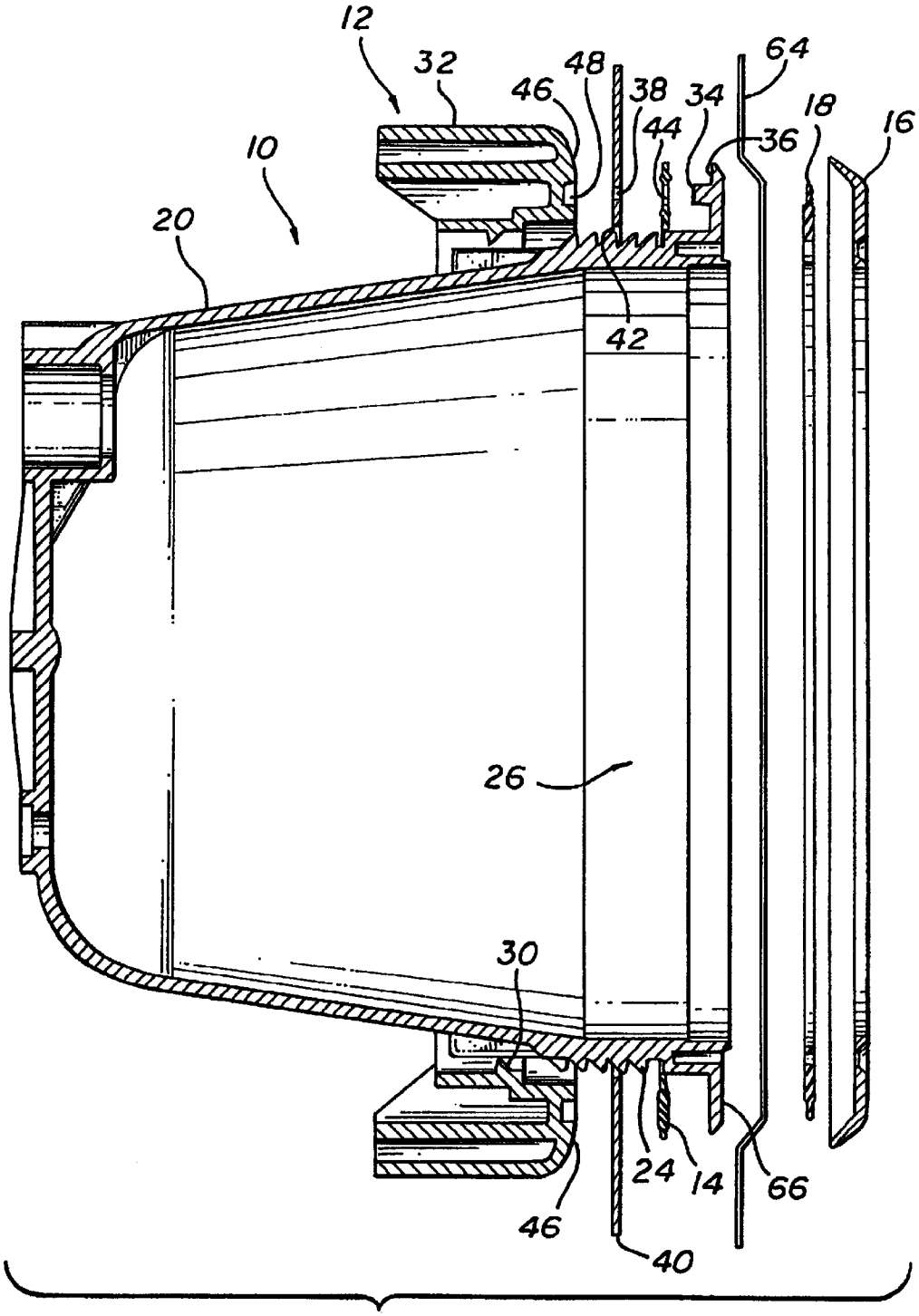
FIG. 2 is an exploded cross-sectional view of the niche assembly shown in FIG. 1.

As illustrated in FIG. 2, which is an exploded cross-sectional view of the niche assembly 8 shown in FIG. 1, a boss 34 is formed on a rear surface 36 of the flange 22 and is configured to inset in a small hole 38 of the pool wall 40 when the niche 10 is fully inserted into the large hole 42. The inset boss 34 prevents rotation of the niche 10 when the backup ring 12 rotates onto the niche 10. Accordingly, a second installer is not required to prevent the niche 10 from rotating during mounting of the niche 10.

In this particular embodiment, the boss 34 has an elongate oval shape and projects perpendicular to the rear surface 36 of the flange 22. Further, the first gasket 14 has a hole 44 configured to allow the boss 34 to extend through and into the small hole 38 in the pool wall 40. A front surface 46 of the backup ring 12 has a channel 48 formed therein for allowing the boss 34 to project into and to allow the backup ring 12 to rotate past the boss 34 while being screwed on to the niche 10.

Referring back to FIG. 1, the niche 10 further includes a plurality of ribs 50 formed on the outer wall 20. The ribs 50 can project from the outer wall 20 and taper at a bottom edge 52 to conform to the curve of the outer wall 20 such that the length along an upper edge 54 is substantially the same distance from an axis through the center of the niche 10 from rear to front. The ribs 50 can also be elongated to adapt for varying pool wall 40 thicknesses.

The backup ring 12 further includes a tab 56 extending from a rear edge 58 of the backup ring 12 and projecting towards the plurality of ribs 50. The tab 56 and the plurality of ribs 50 cooperate to impede the rotation of the backup ring 12 in one direction, that is, to keep the backup ring 12 from being unscrewed. The portion of the tab 56 extending towards the ribs 50 can have a quarter of an oval shape with a curved surface 60 for facilitating movement of the tab 56 over the ribs 50 as the backup ring 12 is screwed on the niche 10 in a clockwise direction (as viewed from the rear). Typically, a hammer is used to tap the at least one handle 32 to assist in moving the tab 56 over the last-crossed rib 50 as the backup ring 12 is fully tightened on to the niche 10.

The opposite side of the quarter of an oval shape can have a straight surface 62 for inhibiting movement of the tab 56 over the ribs 50 as the backup ring 12 is attempted to be unscrewed off the niche 10 in a counter-clockwise direction. Thus, the niche assembly will not easily loosen from the pool wall 40 with time and wear. The tab 56 can be flexible so it is possible to pry it up and over the ribs 50 if necessary to unscrew the backup ring 12.

Figure 3:
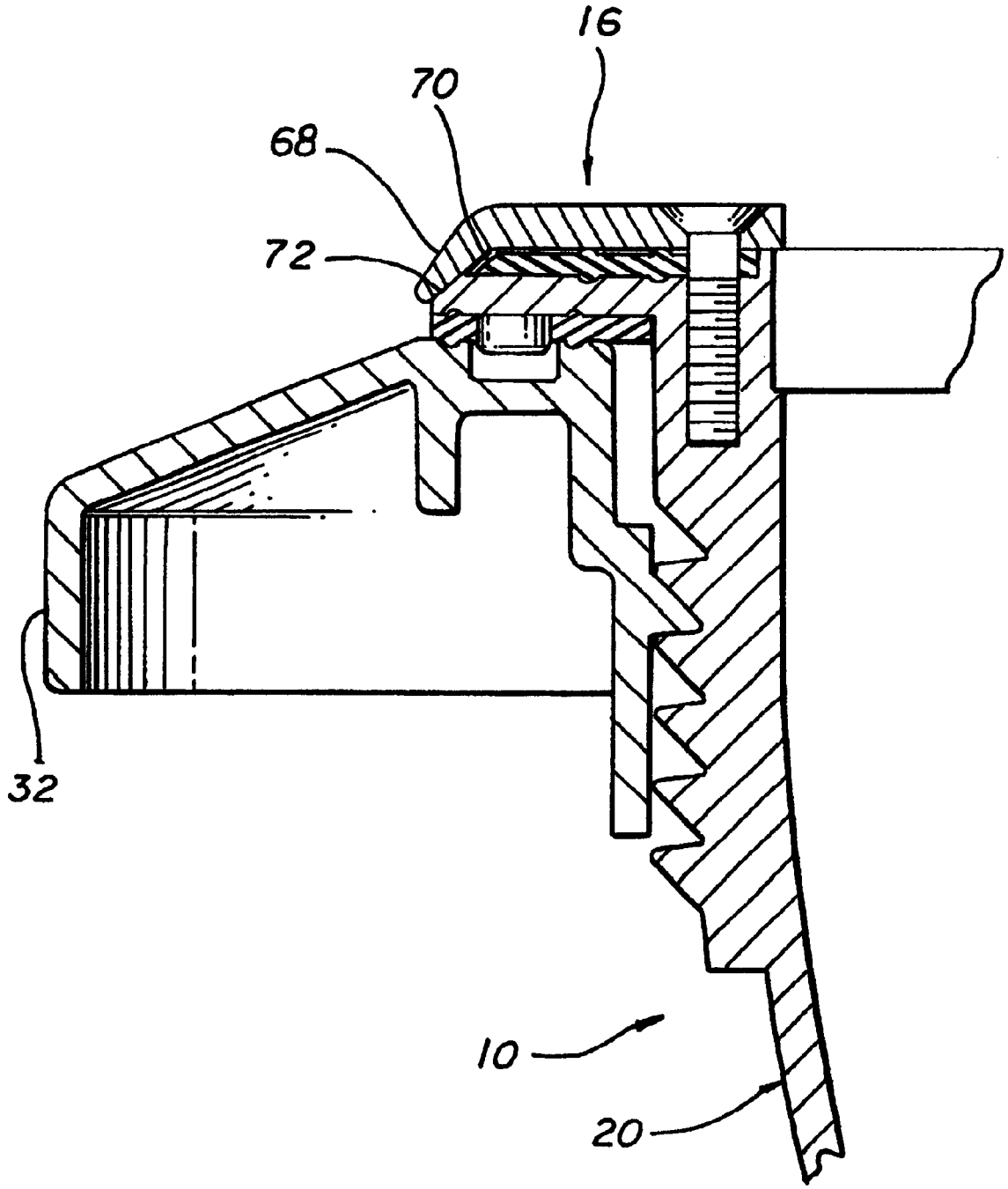
FIG. 3 is a detailed partial cross-sectional view of the assembled niche assembly, particularly showing the flange and the seal ring.

Referring back to FIG. 2, in a vinyl-lined pool installation, a vinyl liner 64 is disposed between a front surface 66 of the flange 22 and the second gasket 18. The seal ring 16 and the second gasket 18 seal the vinyl liner 64 to the flange 22. As shown in FIG. 3, which is a detailed partial cross-sectional view of the assembled niche assembly 8 (the vinyl liner not being shown), the seal ring 16 has a sloping outer edge 68, the second gasket 18 has a beveled outer edge 70, and the flange 22 has a beveled outer edge 72. The sloping outer edge 68 conforms the vinyl liner 62 to the beveled outer edges 70,72. Thus, the vinyl layer does not raise significantly from the pool wall 40 around the perimeter of flange 22, an is thus less susceptible to tears around the pool light because there is no abrupt step from the pool wall 40 to the flange 22.

The niche 10 can be composed of polyvinyl chloride, supplied by various manufactures, such as, Georgia Pacific.

The backup ring 12 can be composed of polyphenylene oxide, such Noryl™ brand supplied by GE Plastics. Both gaskets can be composed of styrene ethylene propylene, such as Kraton™ brand supplied by Shell Chemical Company. The seal ring 16 can be composed of acrylonitrile butadiene stryrene, such as Cyclolac™ brand supplied by GE Plastics. The technique for forming these components is well-known in the art, for example, by injection molding.

The present invention is capable of other and different embodiments, and its several details are capable of modification. For example, a single handle can be used; the boss can have an oval or square shape; the tab can have other shapes; the internal threads can overlap or not overlap, among others.

In conclusion, the niche assembly described herein provides leverage for screwing the backup ring on the niche and prevents the rotation of the niche when the backup ring rotates onto the niche. This is primarily accomplished by at least one handle formed on the backup ring and a boss formed on the flange and configured to inset in a small hole formed in the pool wall.

Furthermore, the niche assembly provides a securely mounted pool light. This is accomplished by the tab and the ribs that impede the backup ring from unscrewing. Also, the niche assembly provides a less puncture prone vinyl-lined instalation. This is accomplished by sloping the outer edge of the seal ring and beveling the outer edge of the flange.

Those skilled in the art will recognize that other modifications and variations can be made in the niche assembly of the present invention and in construction and operation of this niche assembly without departing from the scope or spirit of this invention.

What is claimed is:

1. A niche assembly for a pool, the niche assembly comprising:

a niche with an outer wall, the niche includes,
- a flange formed on the outer wall, and
- external threads formed on the outer wall; and a backup ring including,
- an internal surface with internal threads formed thereon, wherein the internal threads are configured to mesh with the external threads, and
- an external surface having, at least one handle projecting from the external surface to provide leverage sufficient to enable the back up ring to be screwed on by application of force to the handle.

2. A niche assembly for a pool, the pool includes a pool wall with a large hole formed therethrough for insertion of the niche and with a small hole formed therein, the niche assembly comprising:

a niche with an outer wall, the niche includes,
- a flange formed on the outer wall, and
- external threads formed on the outer wall, and
- a boss formed on the flange, wherein the boss is configured to be inset in the small hole when the niche assembly is fully inserted into the large hole and a backup ring including,
- an internal surface with internal threads formed thereon, wherein the internal threads are configured to mesh with the internal threads, and
- an external surface with at least one handle formed thereon.

3. The niche assembly of claim 1, wherein the at least one handle includes two diametrically opposed handles.

4. The niche assembly of claim 1, wherein one end of the outer wall defines an opening into the niche, and the flange is formed on the periphery of the opening.

5. The niche assembly of claim 1, wherein the external threads are adjacent the flange.

6. A niche assembly for a pool, the niche assembly comprising a niche with an outer wall, the niche includes,
- a flange formed on the outer wall, and
- external threads formed on the outer wall, and
- a plurality of ribs formed on the outer wall; and a backup ring including,
- an internal surface with internal threads formed thereon, wherein the internal threads are configured to mesh with the external threads, and
- a tab projecting towards the plurality of ribs, wherein the tab and the plurality of ribs cooperate to impede the rotation of the backup ring in one direction; and
- an external surface with at least one handle formed thereon.

7. A niche assembly for a pool, the pool includes a pool wall and a vinyl liner for covering the pool wall, the niche assembly further comprising:

a niche with an outer wall, the niche includes,
- a flange formed on the outer wall with a beveled outer edge,
- and, external threads formed on the outer wall;

a seal ring with a sloping outer edge;

a gasket;

the seal ring and the gasket sealing the vinyl liner to the flange, wherein the sloping edge conforms the vinyl liner to the beveled outer edge;

a backup ring including,
- an internal surface with internal threads formed thereon, wherein the internal
- threads are configured to mesh with the external threads, and
- an external surface with at least one handle formed thereon.

8. A niche assembly for a pool, the pool including a pool wall with a large hole formed therethrough and with a small hole formed therein, the niche assembly comprising:

a niche with a bowl-shaped outer wall, the niche includes,
- a flange formed on the outer wall for limiting the insertion of the niche through the large hole,
- a boss formed on the flange, wherein the boss is configured to inset in the small hole when the niche is fully inserted into the large hole, and
- external threads formed on the outer wall adjacent the flange; and a backup ring including,
- an internal surface with internal threads formed thereon, wherein the internal threads are configured to mesh with the external threads, and
- an external surface with at least one handle formed thereon, wherein the at least one handle for providing leverage to screw the backup ring onto the niche, wherein the inset boss would prevent rotation of the niche when the backup ring rotates onto the niche.

9. A niche assembly for a pool, the pool includes a pool wall and a vinyl liner for covering the pool wall and an opening in the wall, the niche assembly further comprising:

a niche with an outer wall extending through the opening, the niche includes a flange formed on the outer wall in abutment therewith, the flange with a beveled outer edge sloped inwardly towards the niche wall with the liner overlapping the flange;

a seal ring overlapping the liner with a sloping outer edge generally parallel to the beveled outer edge of the flange;

a gasket between the liner and seal ring inwardly of the outer beveled edge;

the seal ring and the gasket sealing the vinyl liner to the flange, wherein the sloping edge conforms the vinyl liner to the beveled outer edge.

10. A method of mounting a niche assembly to a pool wall with a hole sized to accommodate the niche formed therethrough, using a backup ring which can screw onto the niche to clamp it to the wall, the backup ring having at least one handle projecting therefrom to provide leverage sufficient to enable the backup ring to be screwed on by application of force to the handle, the method comprising:

inserting the niche through the hole until a flange of the niche abuts the wall and thereby limits the insertion; and screwing the backup ring onto the niche by applying force to the at least one handle formed on the backup ring.

11. A method of mounting a niche assembly to a pool wall, with a large and a small hole formed therein, the method comprising;

inserting a boss formed on the flange into the small holes when inserting the niche through the large hole, until a flange of the niche limits the insertion; and screwing a backup ring onto the niche by use of at least one handle formed on the backup ring.

12. A method of mounting a niche assembly to a pool wall with a large hole formed therethrough, the method comprising:

inserting a niche through the large hole until a flange of the niche limits the insertion;

screwing a backup ring onto the niche by use of at least one handle formed on the backup ring; and tapping the handle to set a tab of the backup ring against one of a plurality of ribs formed on the niche.

13. A method of manufacturing a niche assembly, the method comprising:

forming a niche having an outer wall;

forming a flange on the outer wall;

forming external threads on the outer wall;

forming a backup ring having an internal surface and an external surface;

forming internal threads on the internal surface that are configured to mesh with the external threads; and forming at least one handle on the external surface projecting therefrom to enable leverage to be applied to the backup ring sufficient to enable it to be screwed on by application of force to the handle.

14. A method of manufacturing a niche assembly, the method comprising:

forming a niche having an outer wall;

forming a flange on the outer wall;

forming a boss on the flange;

configuring the boss to be inset into a small hole of a pool wall when the niche is fully inserted into a large hole of the pool wall;

forming external threads on the outer wall;

forming a backup ring having an internal surface and external surface;

forming internal threads on the internal surface that are configured to mesh with the external threads; and forming at least one handle on the external surface.

15. The method of claim 13, wherein forming at least one handle on the external surface includes forming at least two diametrically opposed handles on the external surface.

16. A method of manufacturing a niche assembly, the method comprising:

forming a niche having an outer wall;

forming a flange on the outer wall;

forming external threads on the outer wall;

forming a plurality of ribs on the outer wall;

forming a backup ring having an internal surface and external surface;

forming internal threads on the internal surface that are configured to mesh with the external threads;

forming a tab on the backup ring that is cooperative with the plurality of ribs to prevent rotation of the backup ring in one direction; and forming at least one handle on the external surface.

17. A niche assembly for a pool, the niche assembly comprising:

a niche with an outer wall, the niche including,
a flange formed on the outer wall, and
external threads formed on the outer wall;

a backup ring including,
an internal surface with internal threads formed thereon, wherein the internal
threads are configured to mesh with the internal threads; and
a one way motion restraint which impedes rotation of the backup ring in one direction to unscrew the backup ring but permits rotation of the backup ring in an opposite direction to screw on.

18. A niche assembly as defined in claim 17 wherein the one way motion restraint comprises:

a plurality of rotationally spaced ribs formed on one of the outer wall and the backup ring; and a tab attached to the other of the outer wall and the backup ring positioned to successively engage the ribs during rotation of the backup ring during rotation in the other direction during screwing on of the backup ring, the tab being shaped to resiliently deflect and pass over the ribs during motion in the other direction and to resist deflection during motion in the one direction to thereby impede rotation and resist unscrewing.

19. A niche assembly as defined in claim 17 further including, at least one handle projecting from the backup ring to provide leverage sufficient to enable the backup ring to be screwed on by application of force to the handle.

* * * * *